US006887172B2

(12) United States Patent
Arasmith

(10) Patent No.: US 6,887,172 B2
(45) Date of Patent: May 3, 2005

(54) ARROW BROADHEAD

(76) Inventor: Gregory B. Arasmith, 6152 Big Texas Valley Rd., Rome, GA (US) 30165

( * ) Notice: Subject to any disclaimer, the term of this patent is extended or adjusted under 35 U.S.C. 154(b) by 0 days.

(21) Appl. No.: 10/659,618

(22) Filed: Sep. 10, 2003

(65) Prior Publication Data

US 2004/0048704 A1 Mar. 11, 2004

Related U.S. Application Data

(63) Continuation-in-part of application No. 10/120,666, filed on Apr. 11, 2002, now abandoned.
(60) Provisional application No. 60/333,902, filed on Nov. 28, 2001, and provisional application No. 60/283,679, filed on Apr. 12, 2001.

(51) Int. Cl.[7] ..... F41B 6/08
(52) U.S. Cl. ..... 473/583; 473/584
(58) Field of Search ..... 473/583, 584

(56) References Cited

U.S. PATENT DOCUMENTS

| | | | | |
|---|---|---|---|---|
| 2,289,284 A | | 7/1942 | Chandler | |
| 2,684,852 A | | 7/1954 | Romeka | |
| 2,753,643 A | | 7/1956 | Recker | |
| 2,937,873 A | | 5/1960 | Grissinger | |
| 2,940,758 A | | 6/1960 | Richter | |
| 3,014,305 A | | 12/1961 | Yurchich | |
| 3,036,396 A | | 5/1962 | Swails | |
| 3,138,383 A | | 6/1964 | McKinzie | |
| 3,168,313 A | | 2/1965 | Lint | |
| 3,600,835 A | | 8/1971 | Hendricks | |
| 3,604,708 A | | 9/1971 | Brozina | |
| 3,910,579 A | * | 10/1975 | Sprandel | 473/584 |
| 4,169,597 A | * | 10/1979 | Maleski | 473/584 |
| 4,533,146 A | | 8/1985 | Schaar | |
| 4,534,568 A | | 8/1985 | Tone | |
| 4,565,377 A | | 1/1986 | Troncoso, Jr. et al. | |
| 4,579,348 A | | 4/1986 | Jones | |
| 4,671,517 A | | 6/1987 | Winters | |
| 5,145,186 A | * | 9/1992 | Maleski | 473/584 |
| 5,257,809 A | | 11/1993 | Carrizosa | |
| 5,496,042 A | | 3/1996 | Craft et al. | |
| 5,496,043 A | | 3/1996 | Ester | |
| 6,319,161 B1 | | 11/2001 | Martinez et al. | |
| 6,663,518 B1 | * | 12/2003 | Kuhn | 473/583 |

* cited by examiner

*Primary Examiner*—John A. Ricci
(74) *Attorney, Agent, or Firm*—Myers & Kaplan, LLC; Barry E. Kaplan; Ashish D. Patel

(57) ABSTRACT

An improved broadhead arrowhead is disclosed including spiral-shaped, curving or twisting, blades of increasing width along a leading edge thereof, and an insert including a bearing element which allows for broadhead rotation independent of the arrow shaft about the longitudinal axis of the arrow shaft during flight. The curved blades and bearing element of the present invention allow the broadhead to continue rotating after contacting the target.

27 Claims, 4 Drawing Sheets

ARROW BROADHEAD

CROSS-REFERENCE TO RELATED APPLICATIONS

This application is a continuation-in-part of U.S. nonprovisional patent application Ser. No. 10/120,666, filed Apr. 11, 2002, now abandoned, which claims priority to and full benefit of U.S. provisional patent application Ser. No. 60/333,902, filed Nov. 28, 2001, and U.S. provisional patent application Ser. No. 60/283,679, filed Apr. 12, 2001.

TECHNICAL FIELD

The present invention relates generally to arrowheads for use in bow-and-arrow target shooting and hunting; and, more specifically, to an improved broadhead-type arrowhead having superior flight and performance characteristics achieved through the use of curved blades of increasing width as measured from the leading edge thereof to the central axis of the arrowhead, wherein the broadhead-type arrowhead cooperatively functions with a bearing insert to facilitate independent rotation thereof with respect to the arrow shaft.

BACKGROUND OF THE INVENTION

The use of a bow and arrow in lieu of a rifle, shotgun, or the like, in the hunting of game has become increasingly popular in recent years. Many of the game hunters practicing bow and arrow hunting have found the use of a broadhead-type arrow achieves more efficient results, particularly in the hunting of relatively large game. The usual presently available broadhead-type arrow has certain disadvantages in that the speed, distance, and the accuracy of flight of the arrow shaft through the air is frequently adversely affected by the structural configuration of the arrowhead. In addition, there are certain legal requirements setting forth the conditions under which the use and structure of the broadhead-type arrows must comply.

Many attempts have been made to solve the problems encountered with the use of the broadhead-type arrow, such as shown in the Chandler U.S. Pat. No. 2,289,284, issued Jul. 7, 1942, and entitled "Interchangeable Arrowhead;" Recker U.S. Pat. No. 2,753,643, issued Jul. 10, 1956, and entitled "Fishing Arrow;" Grissinger U.S. Pat. No. 2,937,873, issued May 24, 1960, and entitled "Hunting Head for an Arrow or the Like;" Richter U.S. Pat. No. 2,940,758, issued Jun. 14, 1960, and entitled "Arrowhead;" Yurchich U.S. Pat. No. 3,014,305, issued Dec. 26, 1961, and entitled "Arrowhead for Bow Fishing;" Swails U.S. Pat. No. 3,036,396, issued May 29, 1962, and entitled "Retractable Arrow;" McKinzie U.S. Pat. No. 3,138,383, issued Jun. 23, 1964, and entitled "Dual Purpose Arrow Head;" Lint U.S. Pat. No. 3,168,313, issued Feb. 2, 1965, and entitled "Hunting Arrowhead with Retractable Barb;" and Hendricks U.S. Pat. No. 3,600,835, issued Aug. 24, 1971, and entitled "Spear Head with Swingable Barb." Other configurations are also known.

Most prior art broadheads have straight blades in-line with the arrow shaft, and rotate fixedly with the arrow shaft in flight until they come in contact with the target. Specifically, standard fixed inserts for receiving broadheads are designed to be glued into a tubular arrow shaft. Such inserts have internal threads, so that the broadhead, or other types of practice and hunting arrow tips, can be utilized and interchanged. Once the broadhead has been screwed into the insert, the broadhead is fixed or stationary, and thus, rotates only as the arrow rotates in flight. Disadvantageously, when such fixed broadheads impact or contact the target, the arrow as a whole is forced to stop spinning, tears the target upon entry, and thereafter cuts straight through the target without the assistance of any rotational force or inertia, thereby significantly and detrimentally reducing the overall efficiency of the penetrating and cutting action.

Although broadheads having curved blades are available, such broadheads typically possess a pitch too great or too small to effectively penetrate the targeted medium, or often contribute to the skewed flight and/or trajectory of an arrow equipped therewith. More specifically, although a curved-blade broadhead having a large pitch corresponds to an equally large linear displacement of the broadhead through a targeted medium, arrows equipped with such broadheads often experience large deviances from the expected path of trajectory; that is, the expected flight path of the arrow is largely skewed from the selected target, especially when traveling over a relatively substantial distance. Alternatively, although curved-blade broadheads having a small pitch may contribute to a more desirable or expected flight path or trajectory over a selected distance, such broadheads are typically unable to effectively penetrate the targeted medium to a desirable depth; that is, the linear displacement of the broadhead through a targeted medium is accordingly reduced. Examples of such curved-blade broadheads may be seen with reference to Brozina U.S. Pat. No. 3,604,708, issued Sep. 14, 1971, and entitled "Serpentine Arrowhead;" Schaar U.S. Pat. No. 4,533,146, issued Aug. 6, 1985, and entitled "Arrow and Components Thereof;" Carrizosa U.S. Pat. No. 5,257,809, issued Nov. 2, 1993, and entitled "Detachable Rotary Broadhead Apparatus Having Drill Bit-like Characteristics;" and, Martinez et al. U.S. Pat. No. 6,319,161, issued Nov. 20, 2001, and entitled "Arrowhead and Method of Making."

Additionally, although rotational inserts or bearing assemblies are available to assist in providing independent rotational movement of the broadhead relative to the arrow shaft when the arrow is in flight, such rotational inserts typically involve overly complex bearing systems that require unduly burdensome assembly for implementation and utilizations of same. Specifically, most bearing assemblies require the user to glue or otherwise adhesively affix a stationary bearing housing within the arrow shaft, and subsequently insert therethrough a bearing insert, or series of bearing inserts and/or surfaces, typically retained within the bearing housing via lock washers, curved washers, retaining clips, pins, interlocking channel-and-groove assemblies, combinations thereof, and the like. Of particular concern when assembling such bearing systems is the potential for accidentally or unknowingly gluing or adhesively affixing rotational components of the bearing system to fixed components therein, or to the inside of the arrow shaft. For instance, insertion of the bearing housing, or other similar components, into the arrow shaft inherently exerts pressure on the glue, and thus, may push the glue upward and out of the shaft end, and/or downward into areas that may come into contact with the rotational inserts and related components; thus, affixing same upon insertion therein. Although some types of glue may be reheated to release the bonding capabilities thereof, to permit subsequent reassembly of the bearing system, such a task is often burdensome, overly messy, time consuming, and potentially deleterious to the arrow assembly. Examples of such bearing systems may be seen with reference to Sprandel U.S. Pat. No. 3,910,579, issued Oct. 7, 1975, and entitled "Swivel-Mounted Hunting Arrowhead;" Schaar U.S. Pat. No. 4,533,146, issued Aug. 6, 1985, and entitled "Arrow and Components Thereof;" Tone U.S. Pat. No. 4,534,568, issued Aug. 13, 1985, and entitled "Archery Arrow With Freely Rotational Broadblade Arrowhead To Avoid Windplanning;" Winters U.S. Pat. No. 4,671,517, issued Jun. 9, 1987, and entitled "Apparatus for Rotatably Mounting Arrowheads;" and, Carrizosa U.S. Pat. No. 5,257,809, issued Nov. 2, 1993, and entitled "Detachable Rotary Broadhead Apparatus Having Drill Bit-Like Characteristics."

Furthermore, apparently absent from the prior art is a bearing insert and assembly adapted to interchangeably receive a selected arrowhead, yet provide the requisite protection for the end of the arrow shaft to prevent cracking, splitting or damage to same when the arrow and arrowhead ricochets off of or otherwise impacts a target or surrounding surface. Also absent from the prior art is a broadhead having an optimized pitch to interface rotatably with such a bearing insert and assembly.

Accordingly, it would be advantageous to provide a broadhead-type arrowhead having superior flight, penetration and performance characteristics achieved through the use of pitch-optimized spiral-shaped, curving or twisting, blades of increasing width as measured from the leading edge thereof to the central axis of the arrowhead. It would be further advantageous to provide a broadhead-type arrowhead for use in association with a bearing assembly or insert to provide independent broadhead rotation with respect to the arrow shaft, wherein assembly of the bearing insert may be implemented without occurrence of the above-discussed disadvantages, and wherein the bearing assembly further functions to protect the end of the arrow shaft from cracking, splitting or damage resulting from in-flight impact against an object.

BRIEF SUMMARY OF THE INVENTION

Briefly described, in a preferred embodiment, the present invention overcomes the above-mentioned disadvantages and meets the recognized need for such a device by providing an improved arrowhead design which includes pitch-optimized spiral-shaped, curving or twisting, blades of increasing width as measured from the leading edge thereof to the central axis of the arrowhead. The curved blades of the arrowhead provide the arrowhead with a desirable pitch that effectively promotes true-flight, enhanced and more forceful target penetration, and stable and predictable flight path. Additionally, a bearing insert, retained within the arrow shaft via an outer retaining cap, is utilized to support the arrowhead at the end of the arrow shaft. The bearing insert further permits independent rotation of the arrowhead relative to the arrow shaft, wherein the rotation of the arrowhead is preferably substantially along the longitudinal axis of the shaft. Although the outer retaining cap effectively functions to securely retain the bearing insert within the arrow shaft, it equally importantly functions to protect the end of the arrow shaft from potential cracking, breaking, splintering, denting, or other damage, to which the arrow would otherwise be subject to upon forceful impact or collision with trees, rocks, bones, or other solid surfaces when in flight.

The bearing insert of the present invention preferably enables the broadhead-type arrowhead to rotate at a differing rate during flight from the arrow shaft rotation; and, further, upon impact with the target, allows the broadhead to continue in its rotation to penetrate a substantial distance into the target. Such characteristics are facilitated by the spiral-shaped, or twisting, nature of the blades. Advantageously, the above characteristics are provided without the broadhead becoming detached or partially unscrewed from the bearing insert. It is contemplated in an alternate embodiment that an arrowhead having removable or replaceable spiral-shaped, curving or twisting, blades could be utilized in conjunction with the rotating bearing insert of the present invention.

Assembly of the bearing insert requires that the user simply place the insert into the arrow shaft, apply a thin film of adhesive to the exterior of the shaft, proximal the end retaining the bearing insert, and slide the retaining cap thereover. No bearing housing, or series of bearing inserts or structures, is required, nor is the use of washers, clips, pins, or the like to retain the bearing insert therewithin. Additionally, unlike conventional practice of applying glue to the interior of the shaft, the present system requires that glue, or other suitable adhesives, be placed on the exterior of the shaft, thus preventing accidental gluing of the bearing insert to the inside of the arrow shaft, or other fixed components.

Accordingly, a feature and advantage of the present invention is its ability to overcome the deficiencies in prior art broadhead arrowheads by providing an improved arrow broadhead in accordance with the disclosure herein.

Another feature and advantage of the present invention is its ability to provide an improved arrow broadhead.

Yet another feature and advantage of the present invention is its ability to provide an improved arrow broadhead having improved cutting characteristics.

Still another feature and advantage of the present invention is its ability to provide an improved arrow broadhead having improved flight characteristics.

A further feature and advantage of the present invention is its ability to provide an improved arrow broadhead having improved accuracy characteristics.

Still a further feature and advantage of the present invention is its elimination of conventional bearing assemblies and components, and associated methods of assembly and implementation.

Still yet another feature and advantage of the present invention is its ability to provide a bearing insert and assembly adapted to interchangeably receive a selected arrowhead, yet provide the requisite protection for the end of the arrow shaft to prevent cracking, splitting or damage to same when the arrow and arrowhead ricochets off of or otherwise impacts a target or surrounding surface.

These and other features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND SELECTED ALTERNATE EMBODIMENTS

In describing the preferred and selected alternate embodiments of the present invention, as illustrated in FIGS. 1–8, specific terminology is employed for the sake of clarity. The invention, however, is not intended to be limited to the specific terminology so selected, and it is to be understood that each specific element includes all technical equivalents that operate in a similar manner to accomplish similar functions.

Figure 2:
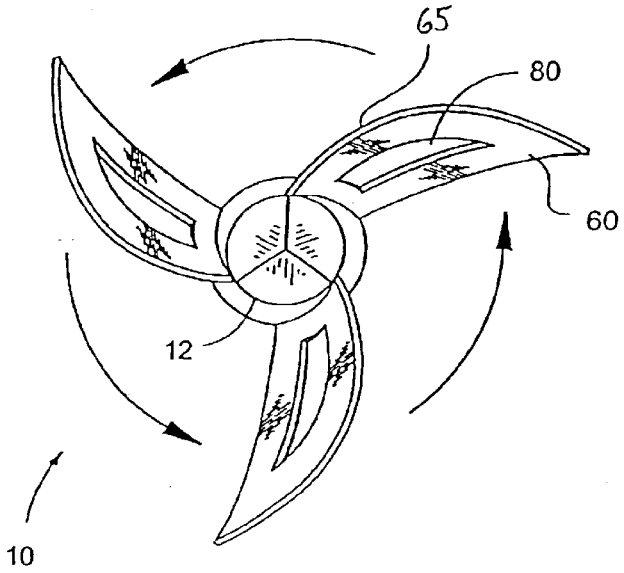
FIG. 2 is an end view of the broadhead of the present invention according to a preferred embodiment thereof, taken from the tip and showing the blades, tip, chisel flats, and aerodynamic cut-out areas of same.
Figure 1:
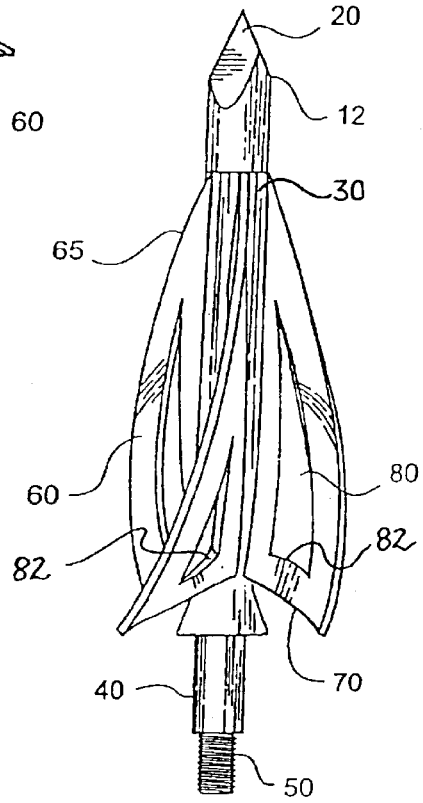
FIG. 1 is a side view of a one piece broadhead of the present invention according to a preferred embodiment thereof.
Figure 3:
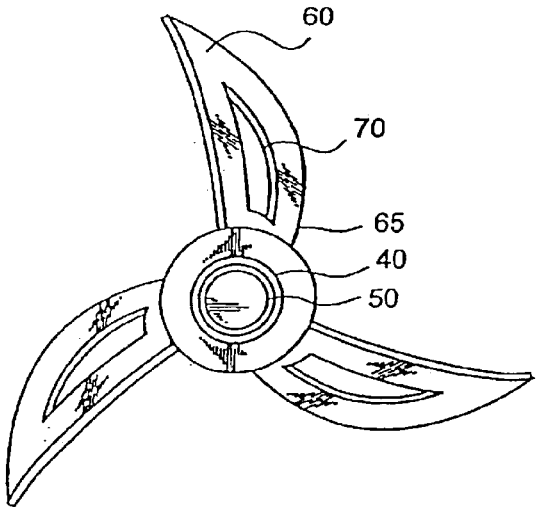
FIG. 3 is an end view of the broadhead of the present invention according to a preferred embodiment thereof, taken from the arrow shaft toward the direction of flight.

Referring now to FIGS. 1–3, in a preferred embodiment, broadhead 10 comprises tip 12 which is pointed on the end and which, optionally, may have a plurality of chisel flats 20 or which may simply be conical in shape. Tip 12, shaft 30, journal 40, threads 50, and blades 60 may be formed as one integral unit. Blades 60 are also preferably formed as one piece with shaft 30 and the other previously mentioned elements. Broadhead 10 is preferably integrally formed from titanium metal; however, it is contemplated in an alternate embodiment that other suitable metals could be utilized, and/or that select portions of broadhead 10 could each be formed from different metals, wherein such metals could include, but are limited to, steel, aluminum, brass, carbon-graphite, boron, or other suitable metals or metal alloys.

Blades 60 comprise cutting edges 65. The cutting width of blades 60 is small near tip 12 and gradually increases rearwardly toward threads 50 along a leading edge of the blade, as taken in view of the direction of flight. That is, blades 60 preferably comprise an increasing width as measured from the leading edge thereof to the central axis of broadhead 10. Maximum cutting width may be achieved at the rearmost portion of blade 60, or may be achieved intermediate the blade length.

Blades 60 preferably comprise a spiral, curved, or twisted shape, curving from front to rear taken in the direction of flight. As such, broadhead 10 preferably comprises a pitch of approximately 11.3, which corresponds to broadhead 10 having a linear translation or displacement of approximately 11.3 inches upon one full rotation thereof. That is, one complete, uninterrupted rotational cycle of broadhead 10 effectively results in broadhead 10 traveling a total linear distance of 11.3 inches through the targeted or selected medium. Advantageously, the curves of blades 60 preferably enhance and promote true flight by imparting a rifling aerodynamic to broadhead 10, thereby facilitating penetration of the targeted medium. Each blade 60 further preferably includes cut relief 70, and an aerodynamic cut-out area 80, both of which reduce the weight and aerodynamic drag of broadhead 10. Additionally, each blade 60 also comprises downwardly tapered area or wind-deflector 82 formed at the base of cut-out area 80, wherein wind-deflector 82 preferably functions to reduce the aerodynamic drag of broadhead 10 by angularly deflecting wind passing through cut-out area 80 when broadhead 10. Broadhead 10 preferably has at least two blades 60, with three such blades being preferred.

Figure 6:
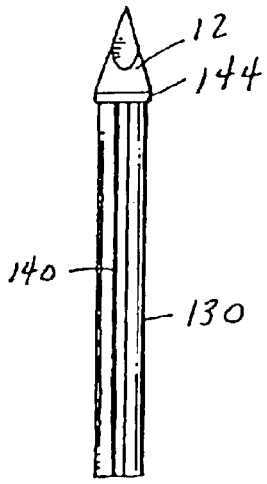
FIG. 6 is a side view of an alternate embodiment of the broadhead of the present invention showing the shaft of the broadhead, tip, and groove.
Figure 7:
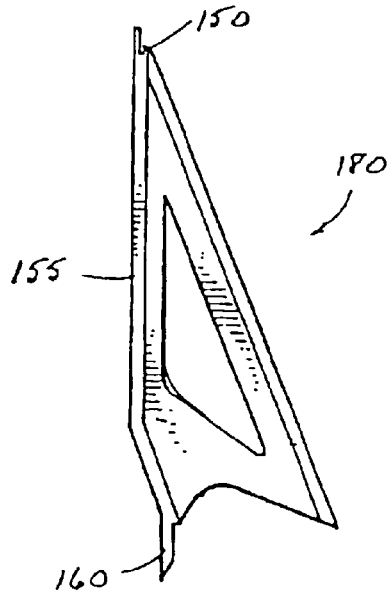
FIG. 7 is a side view of the alternate embodiment of the broadhead of FIG. 6 showing a removable blade, lug, and hook; and, FIG. 8 is a partial side view of the alternate embodiment of the broadhead of FIG. 6 showing one blade and the retainer.
Figure 8:
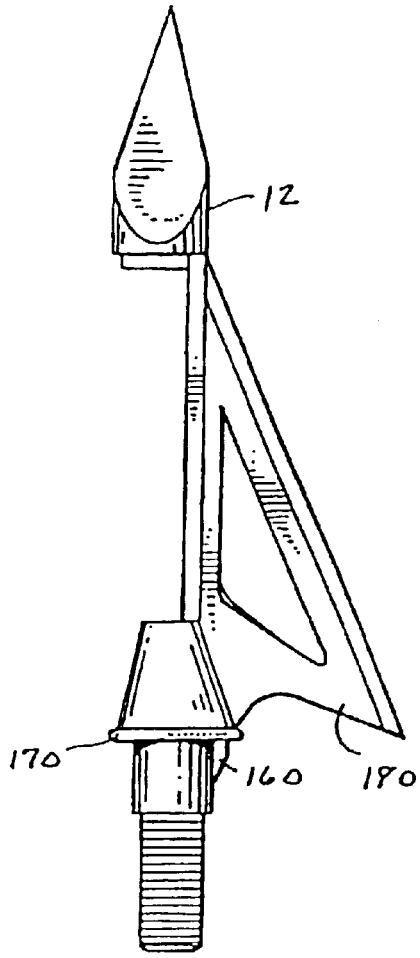

With reference to FIGS. 6–8, in an alternate embodiment, shaft 130 provides undercut 144 immediately adjacent the rear of point 12. Shaft 130 also has a plurality of equally spaced grooves 140, parallel to the axis of flight and equal to the number of blades 180 used.

Blades 180 provide hook 150 proximate their forward end, hook 150 being of suitable configuration such that undercut 144 will retain the forward end of blades 180. Inboard edge 155 of blades 180 fit into groove 140. Proximate rear end of blades 180 is protruding lug 160, which is configured so that retainer 170 may snap over lug 160 and, thereby, hold blades 180 to shaft 130.

Blades 180 share many features with the preferred embodiment of FIGS. 1–3, including, but not limited to: a spiral-shaped, or twisting, curve of increasing width as measured from the leading edge thereof to the central axis of broadhead 10, tip 12 comprising optional chisel flats 20, threaded portion 50, journal 40, based 45, cut relief 70, and aerodynamic cut-out area 80. With the configuration of this embodiment, blades 180 may be quickly and easily replaced while hunting or otherwise.

Figure 4:
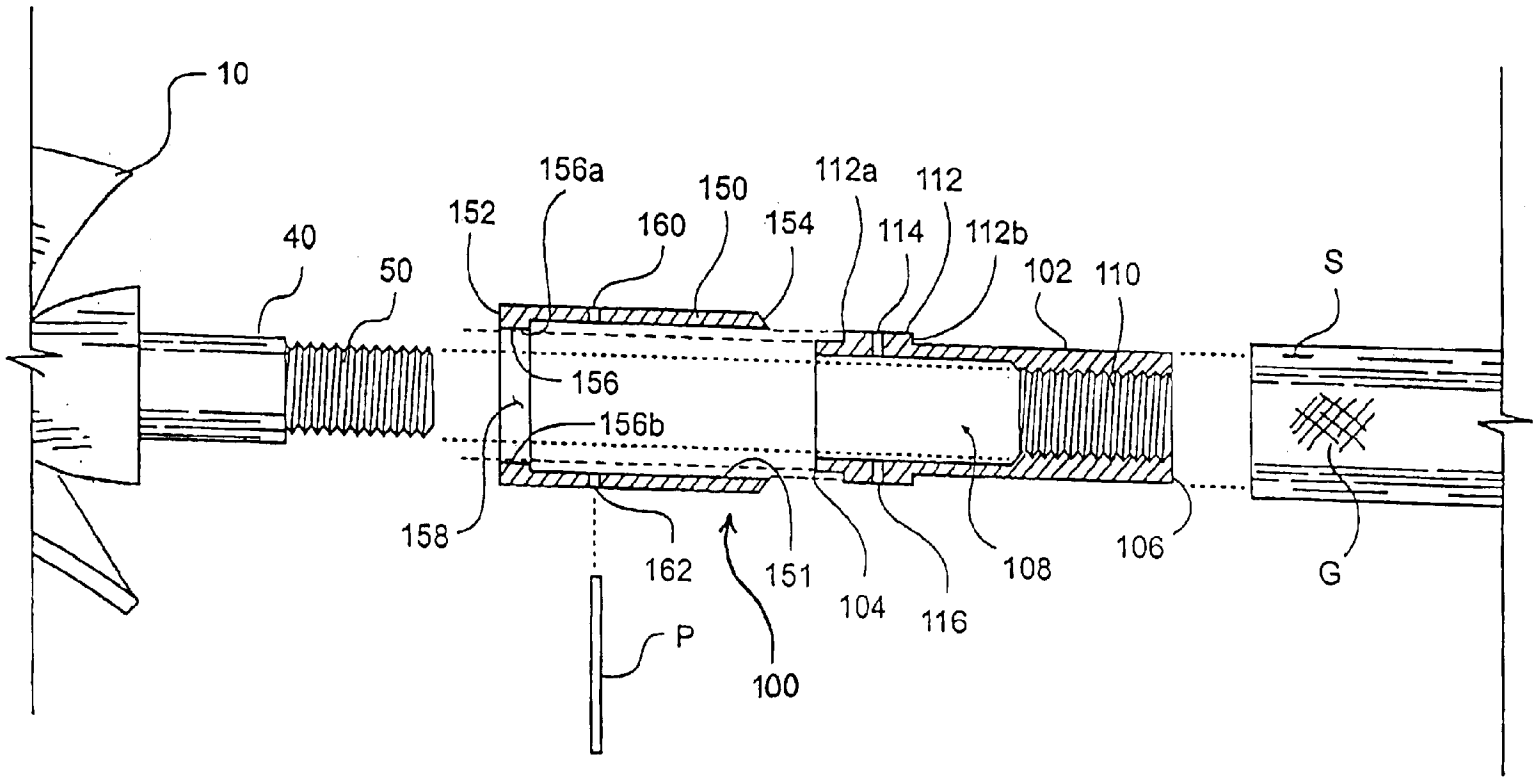
FIG. 4 is a cross-sectional side view of a bearing insert and retaining cap of the present invention according to a preferred embodiment thereof.
Figure 5:
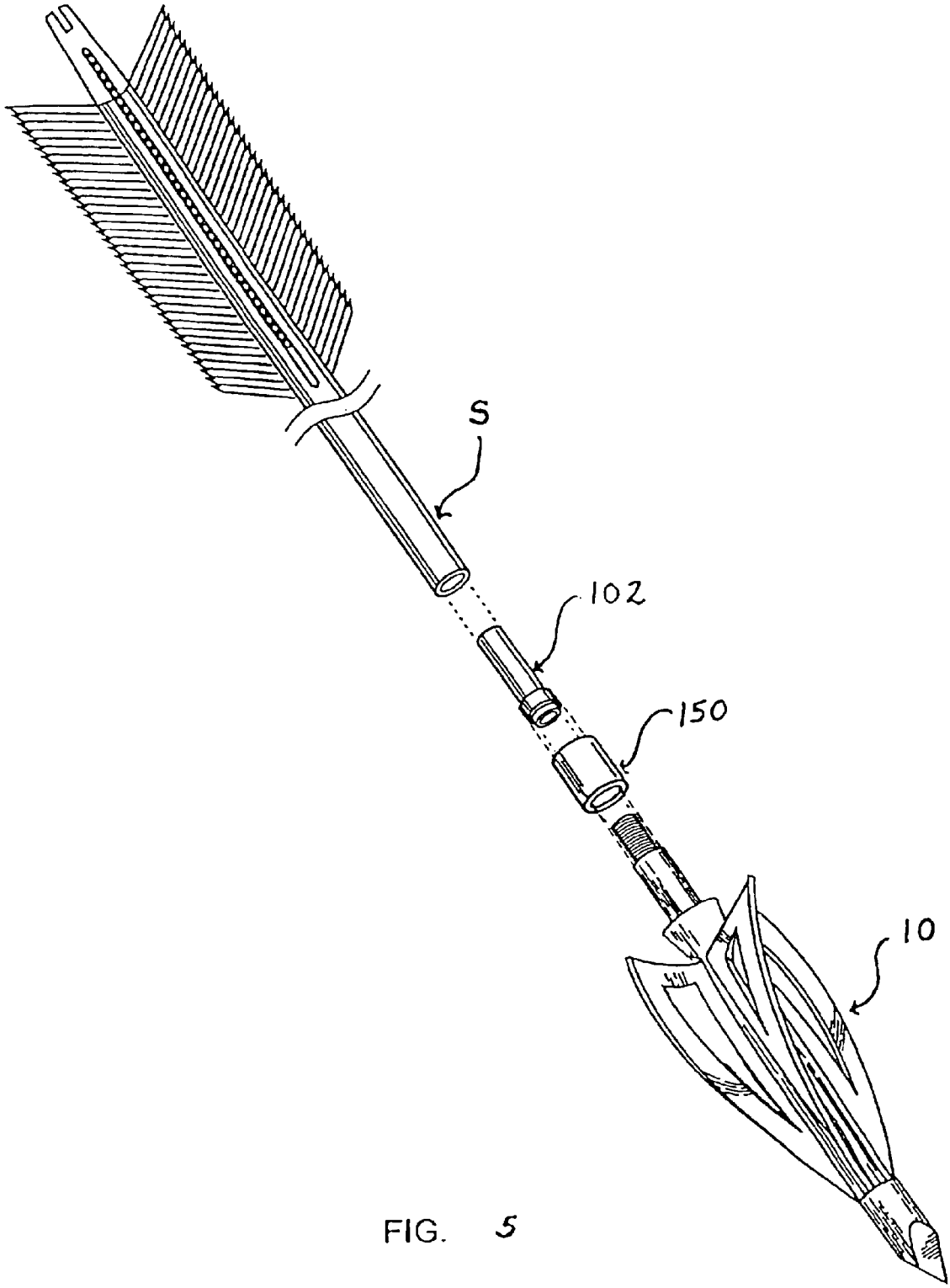
FIG. 5 is an exploded perspective view of an arrow shaft, bearing insert, retaining cap, and broadhead of the present invention according to a preferred embodiment of thereof.

Referring now to FIGS. 4–5, illustrated therein is bearing assembly 100 designed to be utilized with any broadhead, whether of prior art configuration or of the configuration of the several embodiments of the present invention.

Specifically, bearing assembly 100 preferably comprises bearing insert 102 and retaining cap 150, each preferably formed from anodized aluminum metal, thereby increasing the structural integrity and strength of same, and facilitating bearing surface interaction therebetween, as more fully described below. Although bearing insert 102 and retaining cap 150 are preferably formed from anodized aluminum metal, it is contemplated that other suitable, lightweight, anodized or non-anodized metals could be utilized, such as, for exemplary purposes only, steel, brass, boron, and/or other suitable metals or metal alloys. It is further contemplated that suitable non-metals, such as carbon-graphite, could also be utilized to fabricate bearing insert 102 and retaining cap 150.

Bearing insert 102 is preferably substantially cylindrical-shaped, and comprises first end 104, second end 106, inner relief 108, and inner threaded region 110 formed in communication with inner relief 108. Additionally, outer flanged portion 112 is preferably disposed proximal to first end 104, and preferably comprises first peripheral edge 112*a* and second peripheral edge 112*b*, wherein first peripheral edge 112*a* assists in retaining bearing insert 102 within retaining cap 150, and functions as a bearing surface therewithin, as more fully described below. Moreover, upon insertion of bearing insert 102 into the arrowhead receiving end of arrow shaft S, second peripheral edge 112*b* of flanged portion 112 functions as a "stop" thereagainst, and provides the requisite interactive bearing surface therewith.

Preferably, retaining cap 150 is substantially cylinder-shaped and comprises first end 152 and second end 154, wherein inner flanged portion 156 is preferably formed at first end 152 and thus, defines aperture 158. Second end 154 of retaining cap 150 is preferably tapered or beveled to facilitate aerodynamic termination of same. Although retaining cap 150 effectively functions to securely retain bearing insert 102 within arrow shaft S, retaining cap 150 equally importantly functions to protect the end of arrow shaft S from potential cracking, breaking, splintering, denting, or other damage, experienced by the arrow upon forceful impact or collision with trees, rocks, bones, or other solid surfaces when in flight.

Upon inserting second end 106 of bearing insert 102 into arrow shaft S, and flushly seating peripheral edge 112*b* of flanged portion 112 thereagainst, retaining cap 150 is preferably placed or inserted over bearing insert 102 via second end 154 thereof, wherein a sufficient amount of glue G is placed onto the exterior of the end of arrow shaft S to securely adhere retaining cap 150 thereto. In such a configuration, a bearing surface is preferably established between flanged portion 112 of bearing insert 102 and inner surface 151 of retaining cap 150. Moreover, peripheral edge 156*a* of inner flanged portion 156 of retaining cap 150 preferably abuts first peripheral edge 112*a* of outer fanged portion 112 of bearing insert 102; thus, creating a bearing surface therebetween. In addition thereto, first end 104 of bearing insert 102 extends fractionally through aperture 158 of retaining cap 150, thereby facilitating bearing interaction between first end 104 and peripheral wall 156*b* of inner flanged portion 156 of retaining cap 150. As more fully described below, bearing surface interaction between retaining cap 150 and bearing insert 102 preferably permits rotational movement of broadhead 10 when threadably engaged therewith.

More specifically, to provide broadhead 10 with the desired rotational movement, threaded portion 50 of broadhead 10 is preferably inserted through first end 104 of bearing insert 102, and subsequently fully threadably engaged with inner threaded region 110. As a result thereof, journal 40 resides substantially within inner relief 108 of bearing insert 102, and peripheral edge 104*a* of first end 104 of bearing insert 102 preferably abuts base 45 of broadhead 10.

In order to securely tighten or thread broadhead 10 into bearing insert 102, it is necessary to temporarily "fix" bearing insert 102 relative to retaining cap 150. As such, flanged portion 112 of bearing insert 102 preferably possesses diametrically disposed throughholes 114 and 116 formed therethrough, wherein throughholes 114 and 116 preferably align with diametrically disposed throughholes 160 and 162, respectively, formed through retaining cap 150 when bearing insert 102 is engaged therewith. A pin P is preferably inserted through the aligned throughholes to prevent relative rotational movement of same. Once broadhead 10 is securely fastened to bearing insert 102, pin P may be withdrawn. Advantageously, due to the rotational characteristics of bearing assembly 100, blades 60 do not need to be aligned with the fletchings of arrow shaft S while securing broadhead 10 thereto, as is typically the case with conventional fixed broadheads. Bearing assembly 100 allows arrow shaft S and broadhead 10 to spin at differing relative rates of rotation during flight and, also, allows broadhead 10 to continue spinning after impact with a target. Such a configuration further allows the arrow to fly with more accuracy, and allows broadhead 10 to penetrate the intended target more effectively.

Preferably, improved flight characteristics will be achieved by virtue of insert 100 functioning in association with a pitch optimized broadhead 10 (i.e., or other selected broadhead) by providing broadhead 10 with independent rotation relative to the arrow shaft. As a further advantage, the user will not have to adjust bow sights as often, because of truer flight.

It is contemplated that bearing insert 100 could alternatively comprise needle or ball-type bearings. It will be apparent to those ordinarily skilled in the art that sleeve bearings, sintered metal bearings, simple clearance and lubrication arrangements, or the like could also be used within the contemplation of the present invention. Without regard to the specific type of bearing selected, the application and advantages thereof remain the same. It is noted as a design constraint, however, that the bearing should not allow a large relative longitudinal movement between the arrow shaft and the arrowhead.

It is further contemplated that bearing assembly 100 could be manufactured to fit all arrow shaft sizes and, preferably, will glue onto the arrow as described above. The benefit of bearing assembly 100 of the present invention is that once the arrowhead has been screwed into bearing insert 102, the arrow is able to rotate in either direction without becoming unscrewed. It should be recognized that bearing insert 102 of the present invention also accommodates different broadhead designs and fletching pitches.

As described above, broadhead 10 is preferably formed from titanium metal and is cast or otherwise formed as an integral unit, so as to be stronger and more durable than other broadheads currently on the market. Preferably, broadhead 10 will weigh approximately 100 to 125 grains, such weight being the most popular amongst hunters.

Additional modifications and other embodiments of the invention may become apparent to one skilled in the art to which this invention pertains having the benefit of the teachings presented in the foregoing descriptions and the associated drawings. It is to be understood, however, that the invention is not to be limited to the specific embodiments disclosed. It is further to be understood that modifications and other embodiments are intended to be included within the scope of the appended claims. Although specific terms are employed herein, they are used in a generic and descriptive sense only and not for purposes of limitation.

What is claimed is:

1. An improved broadhead arrowhead for affixation to an arrow shaft comprising:

(a.) a forward portion comprising a point;

(b.) a rearward portion for engaging the arrow shaft;

(c.) a curved blade intermediate said forward and rearward portions, wherein the curvature of said curved blade promotes a twisting aspect of said broadhead with regard to a direction of flight;

(d.) said curved blade increasing in width as measured from the leading edge thereof to the central axis of said broadhead, and wherein said curved blade further comprises a cut-out portion, said cut-out portion comprising a downwardly tapered area or wind-deflector formed at the base thereof; and, (e.) a bearing insert disposed within the arrow shaft, wherein a retaining cap is engaged to an exterior portion of the arrow shaft for retaining said bearing insert therewithin, said broadhead arrowhead adapted to engage said bearing insert.

2. The broadhead of claim 1, wherein said broadhead comprises a pitch of approximately 11.3.

3. The broadhead of claim 2, wherein said pitch corresponds to said broadhead having a linear translation or displacement of approximately 11.3 inches upon one full rotation thereof.

4. The broadhead of claim 1, wherein said forward portion further comprises chisel-shaped flats.

5. The broadhead of claim 1, wherein said rearward portion further comprises a thread.

6. The broadhead of claim 1, wherein said rearward portion further comprises a journal.

7. The broadhead of claim 1, wherein said bearing insert allows said broadhead to rotate independently of the arrow shaft.

8. The broadhead of claim 1, wherein said retaining cap is adhered to the exterior portion of the arrow shall and is disposed over said bearing insert disposed within the arrow shall.

9. The broadhead of claim 1, further comprising means for replacement of said blade independently from the remainder of said broadhead.

10. The broadhead of claim 9, wherein said means for replacement of said blade comprises a lug at a rearward portion of said blade and a retainer for cooperating with said lug.

11. The broadhead of claim 9, wherein said means for replacement of said blade comprises a groove for accommodating said blade.

12. An improved arrow comprising:

(a.) a broadhead arrowhead comprising a forward portion carrying a point, a rearward portion for engaging a shaft of said arrow, and a blade intermediate said forward and rearward portions; and, (b.) a bearing insert and retaining cap for accommodating independent rotation of said broadhead arrowhead with regard to said arrow shaft, wherein said retaining cap is engaged to an exterior portion of the arrow shaft for retaining said bearing insert therewithin.

13. The arrowhead of claim 12, wherein said blade is curved to promote a twisting aspect of said broadhead arrowhead with regard to said arrow shaft.

14. The arrowhead of claim 12, wherein said broadhead arrowhead comprises a pitch of approximately 11.3.

15. The arrowhead of claim 14, wherein said pitch corresponds to said broadhead arrowhead having a linear translation or displacement of approximately 11.3 inches upon one full rotation thereof.

16. The arrowhead of claim 12, wherein said retaining cap is adapted to engage said bearing insert.

17. The arrowhead of claim 16, wherein said retaining cap is adhered to the exterior portion of said arrow shaft and is disposed over said bearing insert disposed within the arrow shaft.

18. An apparatus for independently rotating an arrowhead with regard to an arrow shaft, said apparatus comprising:

a bearing insert; and, a retaining cap, wherein said retaining cap is engaged to an exterior portion of the arrow shaft for retaining said bearing insert therewithin.

19. The apparatus of claim 18, wherein said bearing insert is cylindrical-shaped and dimensioned to be seated within an end of the arrow shaft.

20. The apparatus of claim 19, wherein said bearing insert comprises an outer flanged portion that rests atop the end of the arrow shaft, establishing at least one bearing surface therebetween.

21. The apparatus of claim 20, wherein said retaining cap is dimensioned to be seated over said bearing insert, and wherein said flanged portion of said bearing insert contacts at least one inner surface of said retaining cap, establishing at least one bearing surface therebetween.

22. The apparatus of claim 21, wherein a first end of said bearing insert extends at least partially through a first end of said retaining cap when said retaining cap is engaged with said bearing insert, thereby establishing at least one bearing surface therebetween.

23. The apparatus of claim 22, wherein said retaining cap is adhered to the exterior portion of an end of the arrow shaft when said retaining cap is placed over said bearing insert.

24. The apparatus of claim 23, wherein said retaining cap functions to protect the end of the arrow shaft from potential cracking, breaking, splintering, denting, or other damage, as a result of forceful impact or collision of same with trees, rocks, bones, or other solid surfaces.

25. A method of independently rotating an arrowhead with regard to an arrow shaft, said method comprising the steps of:

a. obtaining a bearing insert;

b. placing said bearing insert into said arrow shaft;

c. applying an adhesive to an exterior end of said arrow shaft, proximal said bearing insert;

d. placing a retaining cap over said exterior end of said arrow shaft, thereby establishing a bearing surface between said retaining cap and said bearing insert;

e. securing said arrowhead to said bearing insert; and, f. allowing said arrowhead to independently rotate with regard to said arrow shaft.

26. An improved broadhead arrowhead assembly for affixation to an arrow shaft, comprising:

a broadhead arrowhead comprising a blade, said blade comprising a cut-out portion, said cut-out portion comprising a downwardly tapered wind-deflector formed at the base thereof;

a bearing insert, wherein said bearing insert allows said broadhead arrowhead to rotate independently of the arrow shaft; and, a retaining cap, wherein said retaining cap is engaged to an exterior portion of the arrow shaft for retaining said bearing insert therewithin.

27. An improved broadhead arrowhead assembly for affixation to an arrow shaft, comprising:

a broadhead arrowhead comprising a blade, said blade comprising a cut-out portion, said cut-out portion comprising a downwardly tapered wind-deflector formed at the base thereof;

a bearing insert, wherein said bearing insert allows said broadhead arrowhead to rotate independently of the arrow shaft; and, a retaining cap, said retaining cap engaged to an exterior portion of the arrow shaft for retaining said bearing insert therewithin, wherein said broadhead comprises pitch of approximately 11.3.

* * * * *